United States Patent [19]

Fabbri

[11] Patent Number: 5,072,344

[45] Date of Patent: Dec. 10, 1991

[54] LIGHTING FIXTURE CLAMP

[75] Inventor: William C. Fabbri, Billerica, Mass.

[73] Assignee: Genlyte, Inc., Wilmington, Mass.

[21] Appl. No.: 534,188

[22] Filed: Jun. 6, 1990

[51] Int. Cl.[5] ..... F21S 3/02

[52] U.S. Cl. ..... 362/150; 362/148; 362/396; 362/260

[58] Field of Search ..... 362/217, 225, 148, 150, 362/260, 365, 396

[56] References Cited

U.S. PATENT DOCUMENTS

| | | | |
|---|---|---|---|
| 3,816,880 | 6/1974 | Jacobs | 362/150 |
| 4,086,480 | 4/1978 | Lahm | 362/225 X |
| 4,356,537 | 10/1982 | Stahlhut et al. | 362/148 |
| 4,716,504 | 12/1987 | Pahl et al. | 362/150 |
| 4,803,603 | 2/1988 | Carson | 362/150 |
| 4,860,180 | 8/1989 | Degelmann | 362/150 |

*Primary Examiner*—Ira S. Lazarus
*Assistant Examiner*—Y. Quach
*Attorney, Agent, or Firm*—Kane, Dalsimer, Sullivan, Kurucz, Levy, Eisele and Richard

[57] ABSTRACT

The present invention relates to a lighting fixture which is supported by inverted T-shaped rails of a grid-type ceiling. The lighting fixture is provided with a clamp at least partially excised from the housing of the lighting fixture. This clamp is folded 180° and fastened so as to engage the T-rail and inhibit any relative lateral or longitudinal movement between the T-rail and the lighting fixture.

7 Claims, 2 Drawing Sheets

LIGHTING FIXTURE CLAMP

BACKGROUND OF THE INVENTION

1. Field of the Invention

This invention relates to a clamp for attaching recessed lighting fixtures to flanges of inverted T-shaped rails which comprise a grid-type ceiling. The clamp is at least partially excised from the housing of the lighting fixture.

2. Description of the Prior Art

In the prior art, recessed fluorescent lighting fixtures are mounted on the flanges of inverted T-shaped rails forming a part of a grid-type ceiling. However, such an arrangement requires some means to inhibit the fixture from falling if the T-rails or fixtures shift. This is of particular concern in the event of an earthquake. It is a requirement of the National Electrical Code that such a means be provided.

Typically, this requirement is met by attaching grid clips in the field to secure the fluorescent lighting fixture to the T-rails. However, this procedure is awkward and requires the worker to carry a supply of clips to the job site.

The apparatus of U.S. Pat. No. 4,356,537 to Stahlhut et al. eliminates the need for grid clips by including a retainer hook in the fixture positioned at a right angle (90°) to the fixture so as to engage the T-rail. However, this retainer hook does not prevent longitudinal movement of the lighting fixture along the T-rail. Therefore, this apparatus is deficient in preventing dangerous movement of the fluorescent lighting fixture in the event of an earthquake or any other event which would affect the level position of the T-rails.

OBJECTS AND SUMMARY OF THE INVENTION

It is therefore an object of this invention to eliminate the need for separate grid clips to attach a fluorescent lighting fixture to a T-rail.

It is therefore a further object of this invention to provide an apparatus for attaching a fluorescent lighting fixture to a T-rail so as to inhibit both lateral and longitudinal movement of the fixture with respect to the T-rail, as may occur during an earthquake.

It is therefore a final object of this invention to provide such an apparatus which is simple and inexpensive to manufacture.

The above and other beneficial objects and advantages are attained in accordance with the present invention by providing a fluorescent light fixture wherein an inverted ledge abuts the upper bulb of the inverted T-rail. A portion of the fixture both above and below the ledge is excised on 3½ out of 4 sides of a square so as to allow the installer to snap off the partially excised portion and to fold or rotate the excised portion by 180°. The excised portion is then screwed or otherwise fastened onto the fixture so that a clamping interstice is formed thereby engaging the upper bulb of the T-rail and inhibiting any relative motion, lateral or longitudinal, between the fixture and the T-rail.

As the fixture can be provided to the job site with the partially excised clamp portion still integral with the fluorescent light fixture, the fixture can be installed on the T-rail simply by the use of a screwdriver with no extra or specialized paraphernalia required at the job site.

BRIEF DESCRIPTION OF THE DRAWINGS

Further objects and advantages of this invention will become apparent from the following description and claims, and from the accompanying drawings, wherein:

DETAILED DESCRIPTION OF THE PREFERRED EMBODIMENT

Figure 1:
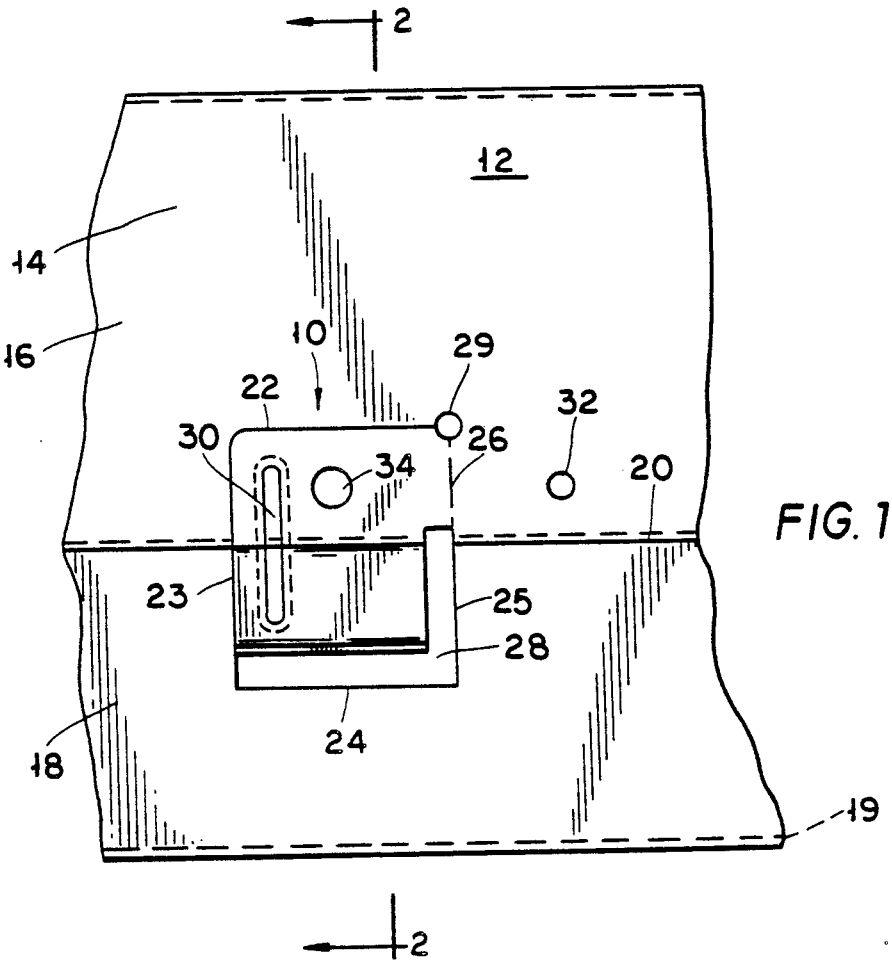
FIG. 1 is a plan view of the clamp of the present invention after partial excision from the lighting fixture but prior to the folding of the clamp onto the lighting fixture.

Referring now to drawings in detail wherein like numerals indicate like elements throughout the several views, FIG. 1 discloses a plan view of the clamp 10 of the present invention after partial excision from the lighting fixture 12 but prior to the folding of the clamp 10 onto the lighting fixture 12. The longitudinal vertical face 14 of lighting fixture 12 includes upper face 16 and lower recessed face 18. Lower recessed face 18 joins bottom horizontal face 19. Inverted ledge 20 is formed between upper face 16 and lower recessed face 18. Clamp 10 is cut from longitudinal face 14 along edges 22, 23, 24 and a portion of edge 25 so as to include a portion of upper face 16, lower recessed face 18 and inverted ledge 20. Edge portion 26 is not cut during production so as to maintain clamp 10 as an integral portion of lighting fixture 12 during transportation. Gap 28 and opening 29 are machined from edge 25 and tool detent 30 is provided so as to allow the installer to fold or "snap off" clamp 10 from lighting fixture 12. Threaded aperture 32 and aperture 34 are provided for screw 36 (see FIG. 3) to hold clamp 10 against lighting fixture 12 during installation.

Figure 2:
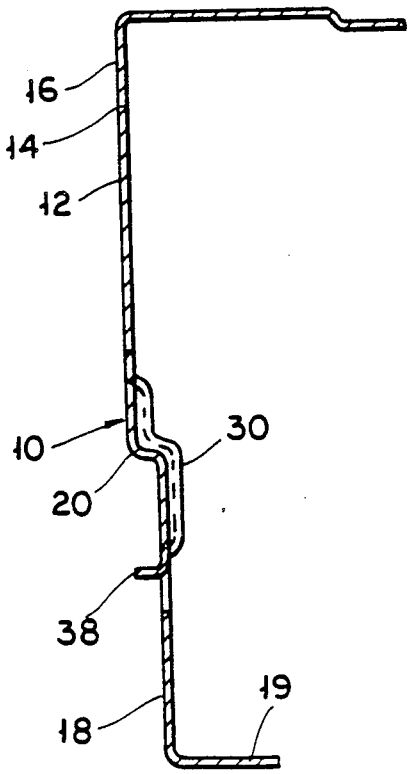
FIG. 2 is a cross-sectional view of the clamp of the present invention along plane 2—2.

As shown in FIG. 2, lip 38 is formed by folding a lower portion of clamp 10 to a horizontal position.

Figure 3:
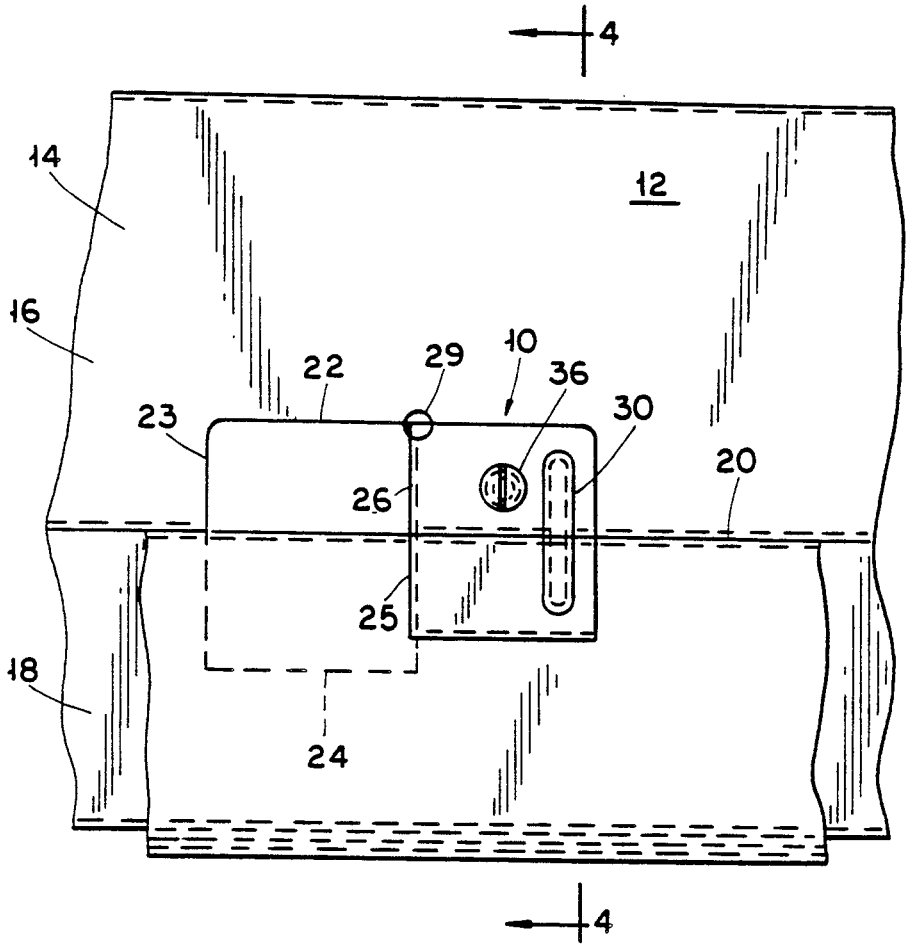
FIG. 3 is a plan view of the clamp of the present invention after folding of the clamp onto the lighting fixture.

FIG. 3 discloses a plan view of the clamp 10 after folding of the clamp 10 onto the lighting fixture 12 so as to engage inverted T-rail 100. As mentioned previously, clamp 10 is typically changed from its position in FIG. 1 to its position in FIG. 3 by the installer at the job site inserting a screwdriver into tool detent 30 and either "snapping off" or folding clamp 10 and installing screw 36 through aperture 34 and threaded aperture 32 so as to engage inverted T-rail 100.

Figure 4:
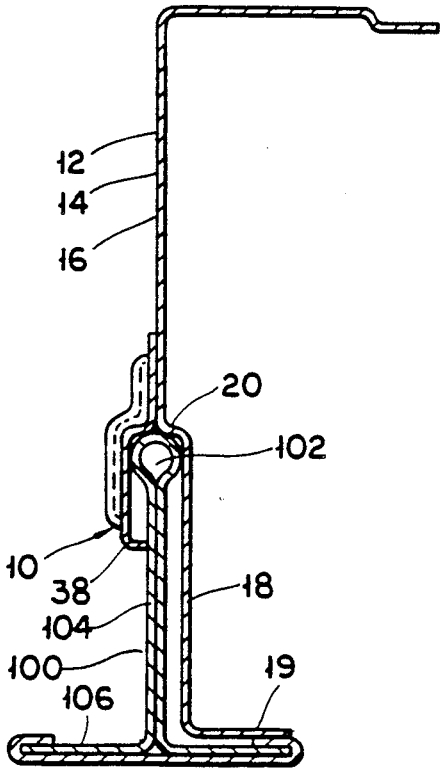
FIG. 4 is a cross-sectional view of the clamp of the present invention along plane 4—4.

As shown in more detail in FIG. 4, inverted ledge 20 of both lighting fixture 12 and clamp 10 forms a space to engage and to abut the upper bulb 102 of stem 104 of inverted T-rail 100. Moreover, bottom horizontal face 19 of lighting fixture 12 is supported by horizontal flange 106 of inverted T-rail 100.

This configuration provides solid support for lighting fixture 12 in the event of longitudinal or lateral movement of inverted T-rails 100. Moreover, solid support of lighting fixture 12 is provided in the event that inverted T-rails 100 move from the horizontal such as may occur during an earthquake.

An alternative embodiment of this invention includes clamp 10 bending downward along a horizontal section above inverted ledge 20 to engage the inverted T-rail 100. In this alternative embodiment, clamp 10 could be excised from an endcap of the lighting fixture 12.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. In a recessed lighting fixture adopted to be laid onto horizontal flanges of inverted T-shaped rails of a grid type ceiling the improvement comprising:

said lighting fixture having a wall having a horizontally extending upper vertical face, a horizontally extending lower vertical face recessed from said upper vertical face and an inverted ledge extending between said upper and lower vertical faces;

a clamp at least partially excised from said fixture wall and including section of said upper and lower vertical faces and said inverted ledge; and, fastening means for securing said clamp to said fixture wall with said inverted ledge of said fixture wall and said inverted ledge of said clamp aligned whereby to space said lower vertical faces of said fixture wall and said clamp apart from one another to form a passageway extending therebetween, said passageway being substantially coextensive in length with said clamp and being configured to clampingly engage a T-shaped rail of said grid-type ceiling therein.

2. The improvement of claim 1 wherein said clamp includes an inverted horizontal lip on its lower edge.

3. The improvement of claim 1 wherein said fastening means comprises a screw and said lighting fixture and said clamp include apertures for engaging said screw.

4. The improvement of claim 1 wherein said passageway is formed by folding said clamp substantially 180° from said partially excised position so that said fixture and clamp upper vertical faces, lower vertical faces and inverted ledges respectively align with each other.

5. The improvement of claim 4 wherein said clamp is partially excised from said lighting fixture on all but one side of said clamp.

6. The improvement of claim 5 wherein said clamp includes a tool detent means whereby the clamp can be bent from its partially excised position in said lighting fixture to its fastened position.

7. The improvement of claim 6 wherein said clamp includes an inverted horizontal lip on its lower edge; wherein said fastening means comprises a screw; and wherein said lighting fixture and said clamp include apertures for engaging said screw.

* * * * *